United States Patent [19]

Ginzburg

[11] Patent Number: 4,555,922

[45] Date of Patent: Dec. 3, 1985

[54] ADAPTIVE STRIP WEDGE CONTROL FOR REVERSING MILL

[75] Inventor: Vladimir B. Ginzburg, Pittsburgh, Pa.

[73] Assignee: Tippins Machinery Company, Inc., Pittsburgh, Pa.

[21] Appl. No.: 630,518

[22] Filed: Jul. 13, 1984

[51] Int. Cl.[4] ..... B21B 1/32; B21B 37/08; B21B 37/14

[52] U.S. Cl. ..... 72/229; 72/14; 72/19; 72/200; 72/240; 72/366

[58] Field of Search ..... 72/229, 240, 14, 19, 72/20, 200, 201, 365, 366

[56] References Cited

U.S. PATENT DOCUMENTS 3,380,277 4/1968 Mulflur ..... 72/200

3,906,764 9/1975 Mueller ..... 72/14 X 4,126,026 11/1978 Fapiano ..... 72/14 X

*Primary Examiner*—Lowell A. Larson

*Assistant Examiner*—Steven B. Katz

*Attorney, Agent, or Firm*—Webb, Burden, Robinson & Webb

[57] ABSTRACT

A process of rolling steel in a reversing mill by passing the steel back and forth through the mill for a selected number of passes to achieve the desired thickness and on at least two early passes, each in a different direction, tapering the ends of the steel during taper passes by adjusting the roll gap, the roll gap adjustment ($\Delta H$) being a function ($F(\Delta F_m)$) of the change in roll force ($\Delta F_m$) above a lock-on force ($F_1$) which lock-on force is established on the instant taper pass.

12 Claims, 8 Drawing Figures

ADAPTIVE STRIP WEDGE CONTROL FOR REVERSING MILL

BACKGROUND

In the process of shaping steel it is usually squeezed through rolls to reduce its thickness. The rolls and associated structure are known in the parlance of the steelmaker as rolling mills or mills. Rolling mills may be classified variously and including (1) single direction, multiple stand mills wherein the successive reductions take place at each stand as the steel progresses through the mill; and (2) reversing mills which often comprise a single stand wherein the steel is passed back and forth through the single stand until successive reductions take place on each pass.

This invention relates to a reversing mill which comprises at least one stand between two driven coilers. The steel must pass back and forth in order to obtain the required reduction. After, perhaps, one pass the steel is thin enough to coil and may then be referred to as steel strip.

Reversing mills are inherently slow and the ends of the steel strip being passed through the mill tend to lose more heat than the remainder of the strip. (The ends are referred to as the head and tail depending upon the direction the steel strip is being processed through the mill.) Due to this cooling, the steel becomes harder near the ends, thereby increasing the resistance to deformation during rolling and the thickness or gauge of the strip increases near the ends (assuming the pressure applied remains constant from end to end of the strip). One established practice has been to automatically taper the ends of the steel in at least one of the early passes by adjusting the roll gap. Ideally, tapering begins at about the location where cooling begins to effect the hardness of the steel and continues until the end. While the tapering could be effected by increasing the roll gap as the head passes therethrough, it is normally effected by decreasing the roll gap as the tail passes therethrough. According to the prior art practice, the start of the taper is arbitrarily begun at a certain distance along the strip before the end thereof. This distance is measured by automatically counting the number of wraps that are collected on the take-up coiler. Simple calculations (given the nominal strip thickness and the reel diameter) enable the establishment of the distance remaining to the end of the strip. Also, according to the prior art, the taper is linear from the start of tapering to the end of the strip. While this technique has its decided advantages and has been used for many years with reversing mills, it also has an unfortunate disadvantage. The start of taper may come sooner or later than required to taper that portion of the strip effected by the end cooling. Also, it assumes that the cooling effect is uniform or a linear function of the distance to the end of the strip. In fact, cooling is not a linear function of the distance to the end of the strip.

Referring now to FIGS. 1, 2 and 3, the relative gauge error as determined by X-ray, the temperature of entry into the mill and the total mill load (the roll separating force to be explained) for one pass of an untapered strip are plotted. The figures rather dramatically illustrate the effect of cooling on gauge thickness. They also show that cooling (and therefore thickness) is not a linear function of distance to the end of the strip. Of course, temperature and strip thickness will vary from strip to strip. As the composition of the steel changes, so does the hardness at given temperatures. Nevertheless, FIGS. 1, 2, and 3 are typical and illustrative.

SUMMARY OF THE INVENTION

Briefly, according to this invention, there is provided a process for rolling steel in a reversing mill comprising the steps of passing the steel back and forth through the mill for a selected number of passes to achieve the desired thickness. On at least two early passes, each in a different direction, tapering of the respective ends of the steel is effected by adjusting the roll gap. Preferably and typically, the tapering is effected by reducing the roll gap as the tail end of the strip passes therethrough. During these tapering passes, the roll gap is adjusted as a function of a differential roll force ($\Delta F_m$) which comprises the difference between a lock-on roll force $F_1$ and the measured or instantaneous roll force $F_m$. The change in roll gap or taper is referred to herein as $\Delta H$. In mathematical terms, $\Delta H = f(\Delta F_m)$. According to a basic embodiment of this invention, a $\Delta H = K \times \Delta F_m$ where K is a constant of proportionality. The constant may be selected considering steel stiffness, mill stiffness, exit thickness, and/or draft. According to a preferred embodiment $K = \Delta H_{max}/\Delta F_{max}$ wherein $\Delta H_{max}$ is the maximum selected decrease in strip thickness over the taper and $\Delta F_{max}$ is the maximum selected increase in rolling force above the lock-on force $F_1$. The lock on force is typically the measured rolled force during the time when the central portion of the strip is passing through the rolling mill.

In any embodiment of this invention, the lock-on force $F_1$ must be established prior to the beginning of tapering. The applicant herein discloses four techniques for establishing lock-on force which is preferably the approximate roll force while a central portion of the steel is being rolled on a taper pass. The lock-on force $F_1$ may be obtained by calculation prior to the taper roll or it may be obtained by sampling during the taper roll. The lock-on force $F_1$ is calculated from certain information concerning the steel and the mill and the draft (percentage reduction) as is well known in the art in which case lock-on force is simply the anticipated force $F_{ant}$. Since, the data upon which the $F_{ant}$ is calculated and the algorithm may not be totally correct, the lock-on force may be more accurately established by measuring the roll force while the central portion of the steel is being rolled during the taper pass. Applicant discloses and claims three embodiments of this invention for measuring roll force during the central portion of the strip passing the rolls; namely, (1) using the measured roll force as the lock-on roll force when the measured length along the steel is equal to a preselected length known to be within the central portion; (2) using the measured rolled force as the lock-on roll force when at spaced times $T_1$, $T_2$, the roll force is found substantially the same, and (3) using the measured roll force when, at spaced distances $L_1$, $L_2$, along the steel, the roll force is substantially the same.

Also, in any embodiment of this invention, the distance along the steel strip during a taper roll at which it is desired to commence the taper must be established. Thereafter, the taper is related to the differential roll force $\Delta F_m$. The applicant discloses and claims four embodiments for determining when the tapering should commence. The first embodiment is by measuring the length ($L_m$) of the strip collected on the take-up reel and commencing tapering when the preselected length $L_r$ has passed. When the roll force increases a preselected increment $\Delta F_r$ between space times $T_1$ and $T_2$ the taper may be commenced or when the roll force increases a preselected increment $\Delta F_r$ between space distances $L_1$ and $L_2$ the tapering may be commenced. When the roll force exceeds a preselected increment $\Delta F_r$ over the anticipated roll force $F_{ant}$ the tapering may be commenced. The advantage of these dynamic techniques is that tapering is begun just before or after the benefit thereof is required.

DESCRIPTION OF THE DRAWINGS

Further features and other objects and advantages of this invention will become clear from the following detailed description made with reference to the drawings, in which.

DESCRIPTION OF THE PREFERRED EMBODIMENTS

Figure 1:
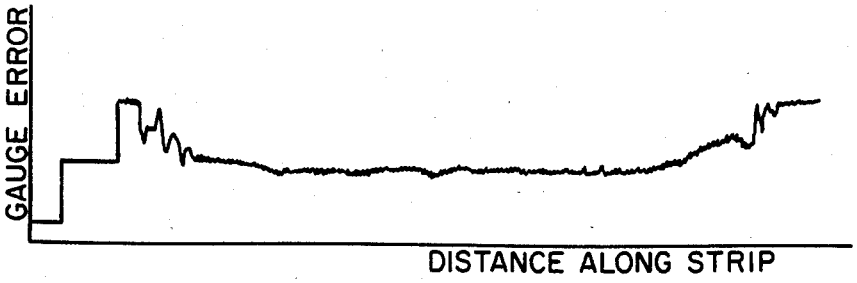
FIGS. 1, 2, and 3, are plots of X-ray gauge error, entry temperature and total roll force respectively for a steel plate or strip being processed through a single stand reversing mill.
Figure 2:
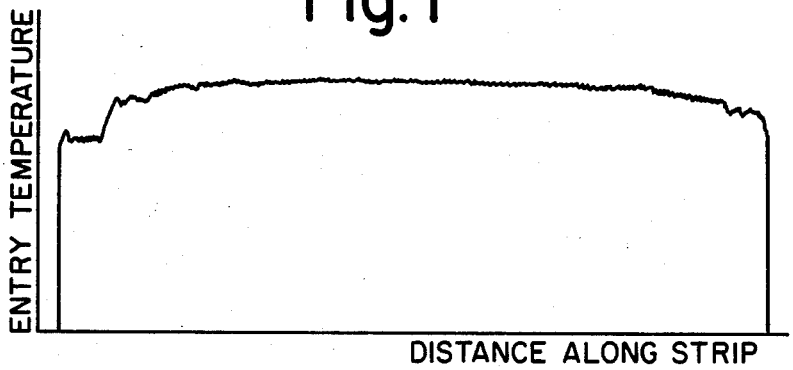
Figure 3:
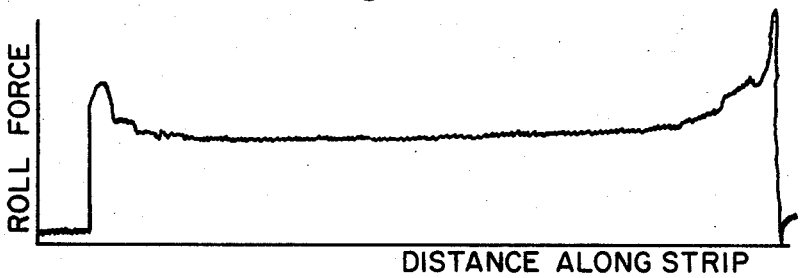
Figure 4:
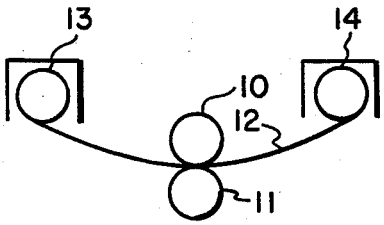
FIG. 4 is a schematic illustration of a reversing mill.

Referring now to FIG. 4, there is shown schematically a reversing mill comprising rolls 10 and 11 through which the steel 12 is passed. The steel is passed first in one direction and then in the other. Typically, the draft (percentage reduction) decreases with each pass. When, for example, the strip is being coiled it is coiled or taken up upon coiler 13 and uncoiled or paid off from coiler 14 and vice versa. The head end is that portion first wrapped upon coil 13 and the tail end is that portion last unwrapped from coil 14 and vice versa. The temperature of a typical strip is substantially uniform in the central portion extending out to the outer few percent of the length of the coil. At each end, the temperature decreases resulting in the need to taper the strip at each end during early passes.

Figure 5:
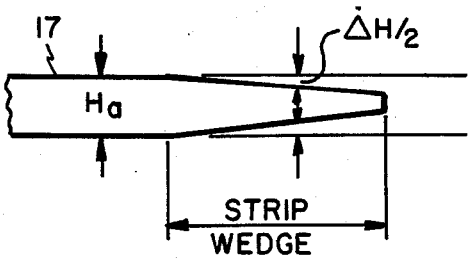
FIG. 5 is a detail of the end of a strip processed according to this invention.

Referring now to FIG. 5, the end of a strip is schematically illustrated. The strip 17 has a nominal thickness $H_a$ which is the desired exit thickness from the rolling mill. The strip wedge is that portion of the strip over which tapering is effected relative to the nominal thickness $H_a$. The nominal strip thickness $H_a$ and the maximum strip tapering ($\Delta H_{max}$) determine the minimum thickness at the very end of the steel strip.

Figure 6:
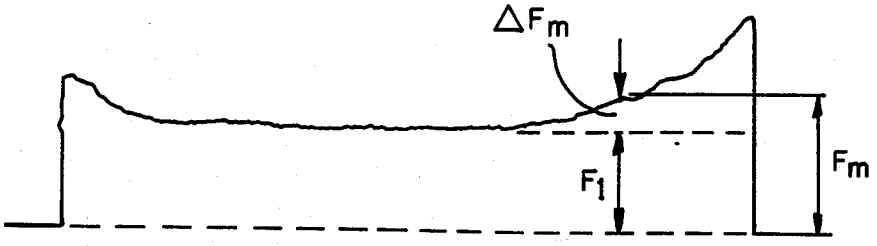
FIG. 6 is a plot of roll separating force versus length of a strip pass through a single stand rolling mill with critical parameters diagrammed thereon.

Referring now to FIG. 6, there is shown a diagram of roll separating force versus length of the strip. During rolling of the central portion of the strip, the roll separating force as measured by load cells is approximately constant and this is the desired lock-on force $F_1$ as will be explained. Near the tail end, the measured roll separating force $F_m$ exceeds the lock-on force by the amount $\Delta F_m$ or the differential rolling force. This is the case whether tapering is effected or not.

Basic to an understanding of all rolling mill operations is the following fundamental equation:

$$H = G_a + F_m x K_s$$

where H is the actual roll gap, $G_a$ is the actual no load roll gap; $F_m$ is the separating force applied by the strip; and $K_s$ is the spring constant of the mill. The product $F_m$ times $K_s$ may be referred to as mill stretch ($G_s$). Hence, the fundamental equation may be written:

$$H = G_a + G_s.$$

Narrowing the actual load gap $G_a$ will result in an increase in roll force and thus mill stretch such that the exit thickness will not be reduced the same increment as the no load gap $G_a$. This is understood by those skilled in the art.

Figure 7:
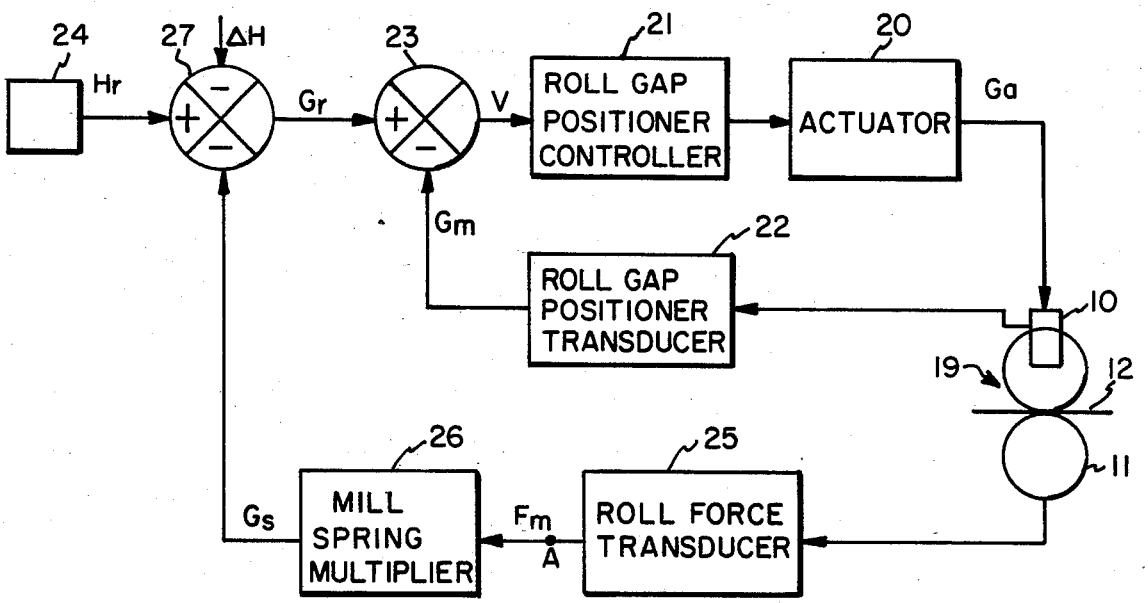
FIG. 7 is a function level diagram of an electronic gauge meter control for practicing this invention.

Referring now to FIG. 7, the rolling mill 19 has associated therewith an actuator 20 for adjusting the no load gap $G_a$. The actuator 20 is controlled by a signal from the roll gap position controller 21 indicative of a desired change in roll gap position. The input to the controller 21 is a signal indicative of the error $\Delta G$ between the roll gap reference signal $G_r$ and the measured roll gap signal $G_m$. The error signal $\Delta G$ is obtained in first summing circuit 23 by subtracting the measured roll gap position $G_m$ (obtained by roll gap position transducer 22) from roll gap reference $G_r$ (to be explained). The controller 21 drives actuator 20 to reduce the error signal $\Delta G$ to near zero.

It should be borne in mind that the gap position $G_m$ (and the signal indicative thereof) is not the actual thickness $H_a$ of the strip passing through the rolls but the no load gap position. Hence, the roll gap position transducer must be able to generate a signal indicative of no load gap even when the rolls are loaded by the strip passing therethrough.

The roll gap reference $G_r$ is generated as follows: a desired exit thickness signal $H_r$ is output from a signal level generator 24 (for example, a potentiometer that has been calibrated). This signal is set prior to a given pass. From $H_r$ is subtracted a signal indicative of mill stretch $G_s$. The subtaction takes place in a second summing circuit 27. The mill stretch signal $G_s$ is obtained by multiplying a signal indicative of roll force $F_m$ (from the roll force transducer 25) by the mill spring multiplier which is characteristic of the particular rolling mill. This multiplication can be accomplished in an adjustable gain amplifier wherein the gain is set according to the mill spring. Thus during rolling a steel plate or strip prior to tapering the roll gap reference may be represented mathematically by $$G_r = H_r - G_s.$$

Tapering is effected by subtracting a signal indicative of the strip tapered $\Delta H$ (output from strip wedge generator 28 (see FIG. 8)) from the $H_r$ signal in summing circuit 27. The roll gap reference can then be given mathematically as $$G_r = H_r - G_s - \Delta H.$$

Figure 8:
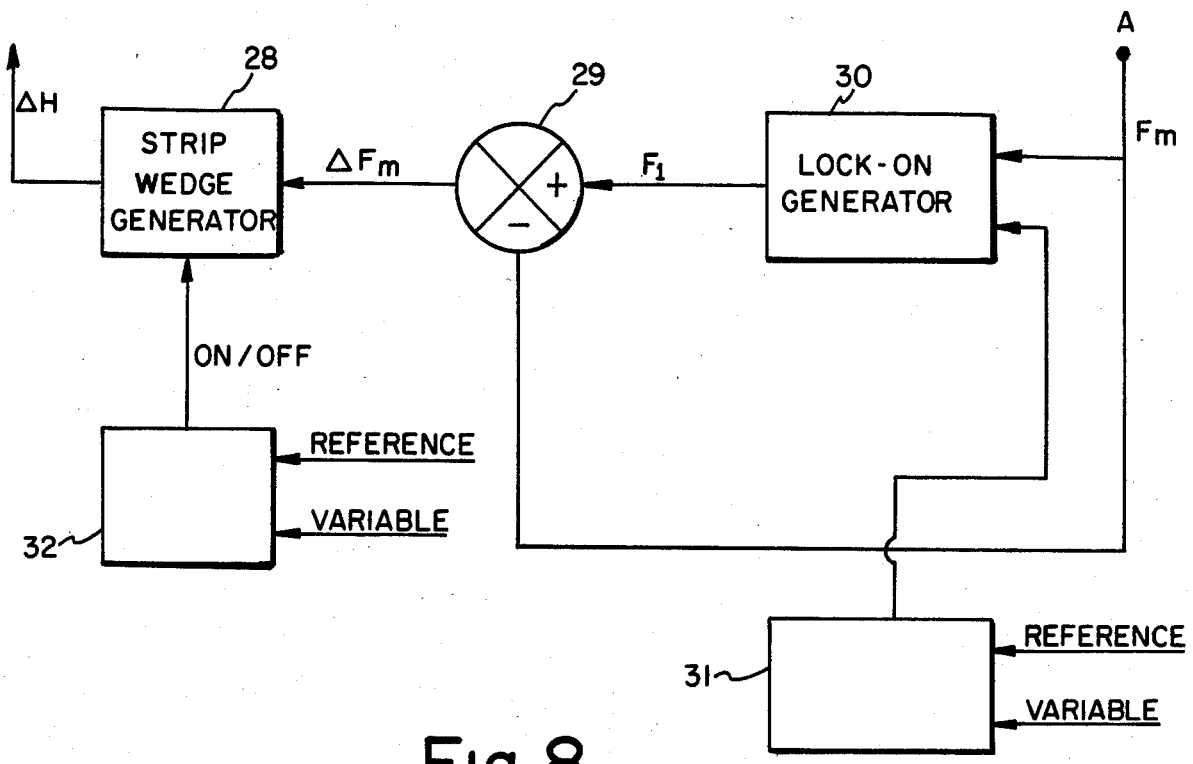
FIG. 8 is a function level diagram of an electronic circuit for generating the strip tapering signal $\Delta H$ for the practice of this invention.

Referring now to FIG. 8, the strip wedge generator 28 is shown schematically. It has two inputs, a signal indicative of the differential roll force $\Delta F_m$ and an on-off signal. The on-off signal is set "off" except during tapering and the generation thereof will be described hereafter.

The output signal $\Delta H$ of the strip wedge generator is a function of the differential roll force signal $\Delta F_m$ and may be generalized mathematically as:

$$\Delta H = F(\Delta F_m).$$

In a simple embodiment, output $\Delta H$ may be proportional to the roll force as where $\Delta H$ equals K times $\Delta F_m$ and K represents the constant of proportionality. In this case, the strip wedge generator may simply be an adjustable gain amplifier wherein the adjustment of gain establishes the desired K.

A differential roll force signal $\Delta F_m$ input to the strip wedge generator is generated by comparing in summing circuit 29 the measured roll force signal $F_m$ from the roll force transducer 25 to a lock-on roll force signal $F_1$. The lock-on signal $F_1$ is the output of a sample and hold circuit 30 which samples the roll force signal $F_m$. The instance of the sampling is controlled by the strobe input which may be generated in several preferred ways all of which involve a comparison circuit 31 having a constant reference input and a variable input. In a first embodiment, the constant reference input is a signal indicative of strip length $L_1$ and the variable input is a signal indicative of measured strip length $L_m$. In variations of this embodiment, the strip length may be taken as that paid off the reel and passed through the roll or that remaining on the reel. When $L_1$ equals $L_m$, the output pulse strobes the lock-on generator to sample the roll force signal $F_m$. The reference $L_1$ (produced by a signal level generator, for example, a potentiometer) is set so that the sample is taken in the central portion of the strip.

In a second embodiment, the reference input to the comparison circuit 31 is a signal indicative of anticipated roll force $F_{ant}$ during rolling prior to tapering and the variable input is measured roll force. The lock-on roll force $F_1$ will, of course, be the anticipated roll force $F_{ant}$, if the roll force falls to this level following the head portion of the strip passing through the mill.

In a third embodiment, the reference signal to the comparison circuit 31 is a roll force signal taken at a first instance $F_m$ ($T_1$) (for example by a sample and hold circuit) and the variable input is a roll force signal taken at a later instance $F_m$ ($T_2$). A clock circuit (not shown) will be required to time the sampling of $F_m$ at times $T_1$ and $T_2$. During the central portion of the strip, the roll force remains substantially constant from instance to instance and the roll force signal $F_m$ at this time is captured as the lock-on force ($F_1$). Consider that the reference and variable inputs must be repeatedly gathered at spaced times until $F_m$ ($T_1$) equals $F_m$ ($T_2$). A number of variations of this procedure are possible. The roll force signal may be sampled and used as the lock-on force when $$F_m(T_2) - F_m(T_1) < \Delta F_r$$

where $\Delta F_r$ is selected small enough to insure that the constant temperature portion of the strip is within the roll bite but large enough to discount minor statistical variations.

A fourth embodiment is very similar to the third embodiment except the roll force at spaced distances $L_1$ and $L_2$ is repeatedly sampled and compared until equal or less than a preselected $\Delta F_r$. At that time, the roll force $F_m$ is taken as the lock-on force $F_1$.

The "on" signal for initiating tapering is generated by one of several techniques all of which may use a comparison circuit 32 which normally outputs an "off" signal. The "on" signal is generated when a variable input equals or exceeds a reference input by a given amount. The reference and variable inputs may be selected in several ways.

According to one embodiment of this invention, the variable input to comparison circuit 32 is a signal indicative of measured strip length $L_m$ and the reference is a signal indicative of strip length $L_s$. When $L_m$ equals $L_s$, then the "on" signal is generated. With this embodiment, the mill operator must have prior knowlege of the approximate location on the strip where cooling and hardening begins in order to properly assign $L_s$.

According to yet another embodiment, the reference input to the comparison circuit 31 comprises a signal indicative of the anticipated roll force $F_{ant}$ plus a preselected rolling force increment $\Delta F_r$ and the variable input is a signal indicative of the measured rolling force $F_m$. Here, the "on" signal is generated when $F_m$ equals $F_{ant}$ plus $\Delta F_r$.

The advantage of this embodiment is that it establishes the start of taper at the correct location without the need of prior knowledge about the temperature distribution of the strip being passed through the mill. However, it does require an ability to accurately calculate $F_{ant}$ from nominal temperature, composition and other data regarding the strip.

In yet another embodiment, the input reference is the roll force signal captured at time $T_1$ and the input variable is the roll force signal at at a later time $T_2$. The times $T_1$ and $T_2$ are separated by a preselected interval $\Delta T$. A comparison circuit outputs an "on" signal when measured rolling force $F_m$ ($T_2$) exceeds the roll force $F_m$ ($T_1$) by a selected increment of rolling force $\Delta F_r$. The roll force signal must be repeatedly sampled at subsequent times $T_1$ and $T_2$ until the condition $F_m$ ($T_2$) minus $F_m$ ($T_1$) equals $\Delta F_r$ is encountered. Note that with this embodiment, no prior knowledge of the strip temperature distribution or its anticipated roll force $F_{ant}$ is required.

Yet another embodiment is substantially identical to that just described except roll force signal is repeatedly sampled at spaced distances $L_1$ and $L_2$ along the strip and the "on" signal is generated when $F_m$ ($L_2$) minus $F_m$ ($L_1$) equals $\Delta F_r$.

The various ways disclosed in which lock-on force $F_1$ may be established can be combined with the various ways disclosed in which the "on" signal may be generated. As a practical matter, the "on" signal generated by detection of signals $F_m(T_1)$ and $F_m(T_2)$ is used with the lock-on signal which is generated by using these two input signals; the "on" signal generated by detection of signals $F_m(L_1)$ and $F_m(L_2)$ is used with the lock-on signal which is generated by using these two signals; the "on" signal which is generated using $L_m$ is used with the lock-on signal which is generated using $L_m$; and, finally, the "on" signal generated using $F_{ant}$ is used with the lock-on signal which is generated using $F_{ant}$.

I claim:

1. A process of rolling steel in a reversing mill comprising the steps for:

(a) passing the steel back and forth through the mill for a selected number of passes to achieve the desired thickness, (b) on at least two early passes, each in a different direction, tapering the ends of the steel during taper passes by adjusting the roll gap, said roll gap adjustment ($\Delta H$) being a function ($F(\Delta F_m)$) of the change in roll force ($\Delta F_m$) above a lock-on force ($F_1$) for which the roll gap adjustment ($\Delta H$) increases as the change in roll force ($\Delta F_m$) increases to effect a taper, said lock-on force and the beginning of tapering being dynamically established on the instant taper pass.

2. A process according to claim 1 wherein the roll gap adjustment function ($\Delta H = Kx\Delta F_m$) is one of direct proportionality wherein K is a preselected constant of proportionality.

3. A process according to claim 2 wherein the constant of proportionality K is $\Delta H_{max}$ divided by $\Delta F_{max}$ wherein $\Delta H_{max}$ is the maximum selected decrease in strip thickness throughout the taper and the instant pass and $\Delta F_{max}$ is the maximum selected increase in roll force above the lock-on force $F_1$.

4. A process according to claim 3 wherein the roll force is not increased above a preselected maximum.

5. A process according to claim 1 wherein the taper is effected upon the tail end of the steel on the taper pass.

6. A process according to claim 1 wherein the lock-on force ($F_1$) is established when the measured length of the steel ($L_m$) equals a preselected lock-on length ($L_1$) and the lock-on force is taken as the roll force ($F_m$) at that instance.

7. A process according to claim 1 wherein the lock-on force ($F_1$) is established by repeatedly at spaced times $T_1$ and $T_2$ measuring roll force and when at spaced times $T_1$ and $T_2$ the measured force remains substantially the same (i.e., $F_m$ ($T_1$) equals about $F_m$ ($T_2$)) taking the roll force $F_m$ as the lock-on force.

8. A process according to claim 1 wherein the lock-on force ($F_1$) is established by repeatedly at spaced distances $L_1$ and $L_2$ measuring roll force and when at spaced distances $L_1$ and $L_2$ the measured force remains substantially the same (i.e., $F_m$ ($L_1$) equals about $F_m$ ($L_2$)) taking the roll force $F_m$ as the lock-on force.

9. A process according to claim 1 or 7 wherein the beginning of taper during the taper pass is established by repeatedly measuring roll force at spaced times $T_1$ and $T_2$ and when the change in measured roll force between the times $T_1$ and $T_2$ (i.e., $F_m$ ($T_2$) minus $F_m$ ($T_1$)) exceeds a preselected increment ($\Delta F_r$) starting the tapering.

10. A process according to claim 1 or 7 wherein the beginning of tapering during a taper pass is established by repeatedly measuring roll force at spaced lengths $L_1$ and $L_2$ along the strip and when the change in measured roll force between lengths $L_1$ and $L_2$ (i.e., $F_m$ ($L_2$) minus $F_m$ ($L_1$)) exceeds a preselected increment ($\Delta F_r$) starting the tapering.

11. A process according to claim 1 or 6 wherein the beginning of tapering during a tapering pass is established by setting a reference length $L_r$ and continually measuring strip length $L_m$ and when $L_m$ equals $L_r$ starting the tapering.

12. A process according to claim 1 wherein the beginning of tapering is established during a taper pass by setting a reference sum roll force equal to the anticipated roll force $F_{ant}$ plus a reference increment $\Delta F_r$ and continually comparing the reference sum to the measured roll force $F_m$ and when $F_m$ equals $F_{ant}$ plus $\Delta F_r$ starting the tapering.

* * * * *